US005478276A

United States Patent [19]

Lee

[11] Patent Number: 5,478,276

[45] Date of Patent: Dec. 26, 1995

[54] AIR CONDITIONER OPERATION CONTROL APPARATUS AND METHOD THEREOF

[75] Inventor: Seung-Kwan Lee, Suwon, Rep. of Korea

[73] Assignee: Samsung Electronics Co., Ltd., Suwon, Rep. of Korea

[21] Appl. No.: 261,262

[22] Filed: Jun. 14, 1994

[30] Foreign Application Priority Data

Jun. 14, 1993 [KR] Rep. of Korea ..... 93-10819
Apr. 23, 1994 [KR] Rep. of Korea ..... 94-8658

[51] Int. Cl.[6] ..... G05D 23/00; G02B 27/32

[52] U.S. Cl. ..... 454/256; 33/1 V; 236/51; 356/380

[58] Field of Search ..... 236/49.3, 51, 94; 62/187, 179; 454/258, 315, 256; 33/1 V; 356/380

[56] References Cited

U.S. PATENT DOCUMENTS 5,176,006 1/1993 Ikawa et al. ..... 236/51 X
5,331,825 7/1994 Kim ..... 62/180

*Primary Examiner*—William E. Wayner
*Attorney, Agent, or Firm*—Burns, Doane, Swecker & Mathis

[57] ABSTRACT

The air flow discharged from a room air conditioner is controlled by a mechanism which determines the shape of the room and the location of the air conditioner relative to the room to control the direction of the air flow and the angular size of the air flow in accordance with the room shape and air conditioner position.

22 Claims, 10 Drawing Sheets

FIG. 6(a)
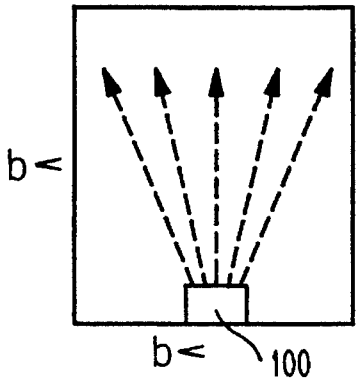
FIG. 6(b)
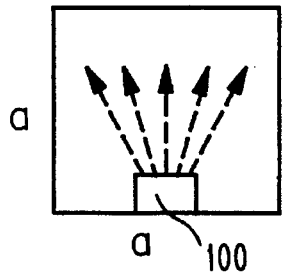
c>b>a
FIG. 6(c)
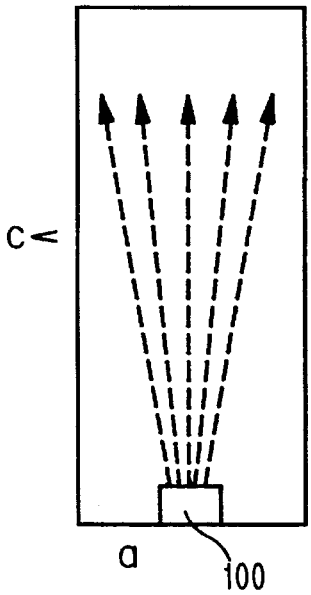
FIG. 6(d)
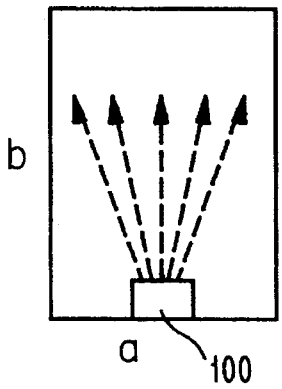
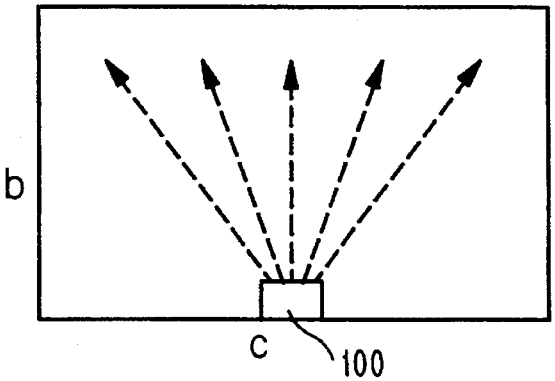
FIG. 6(e)
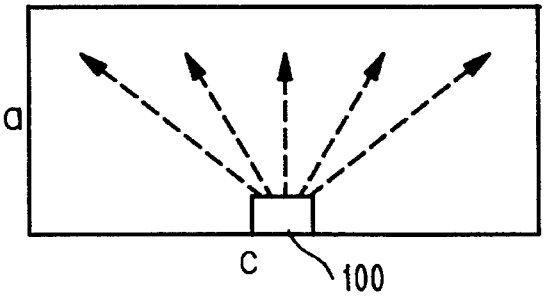
FIG. 6(f)

FIG. 7(a)
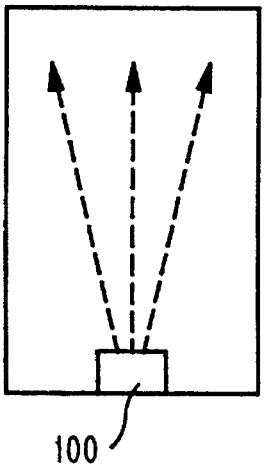
FIG. 7(b)
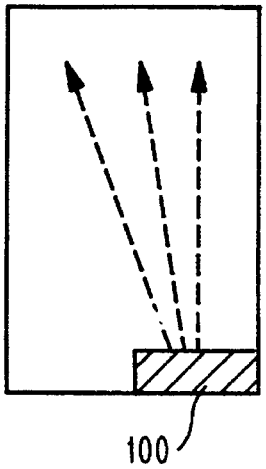
FIG. 7(c)
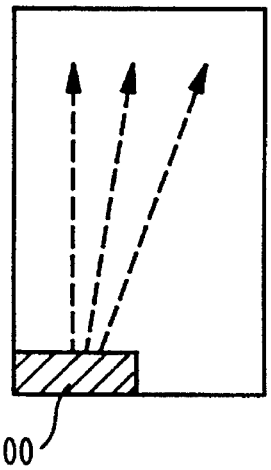
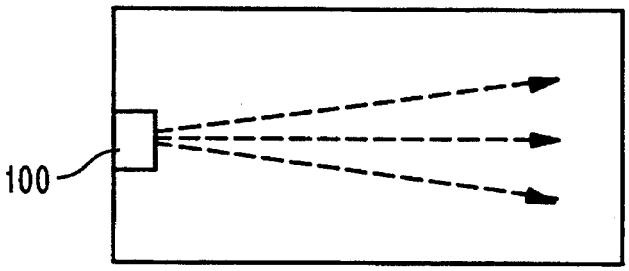
FIG. 7(d)
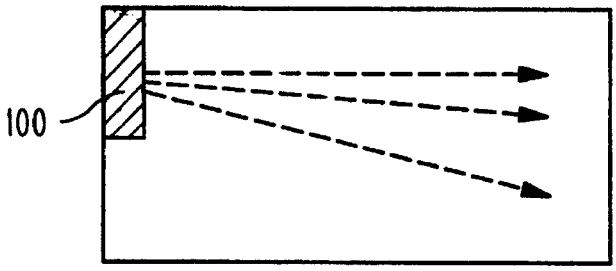
FIG. 7(e)
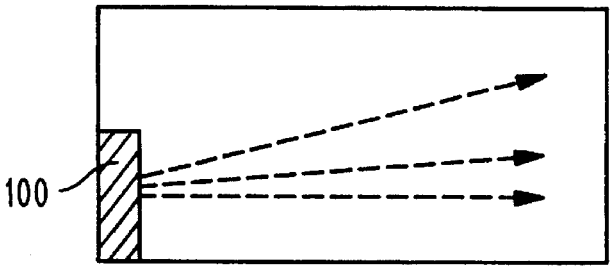
FIG. 7(f)

FIG. 8(a)
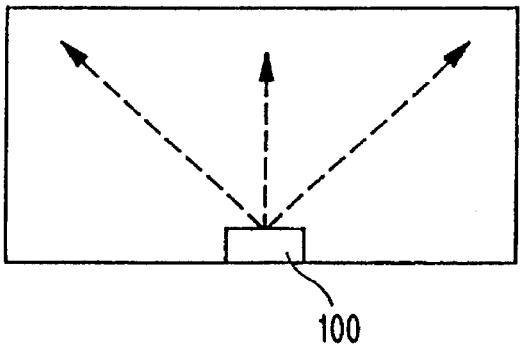
FIG. 8(b)
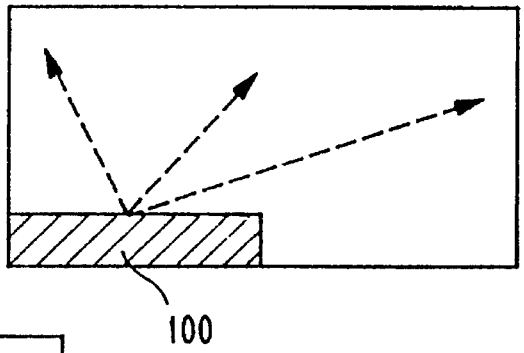
FIG. 8(c)
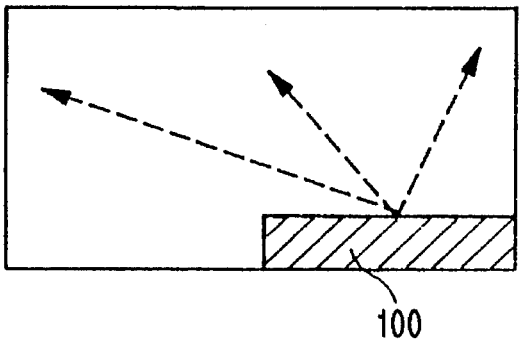
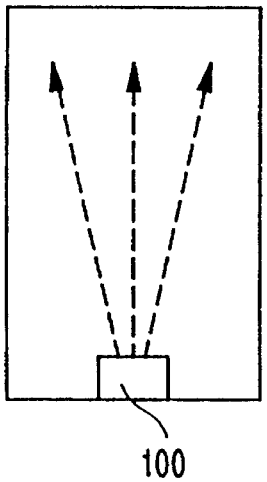
FIG. 8(d)
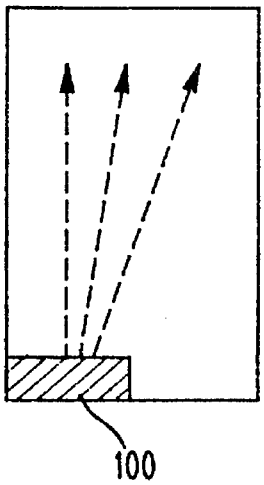
FIG. 8(e)
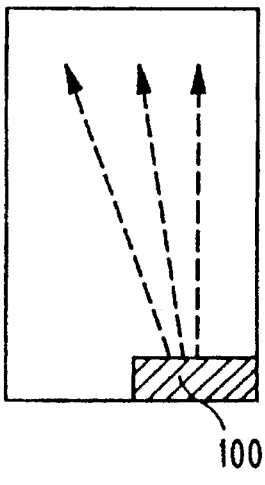
FIG. 8(f)

AIR CONDITIONER OPERATION CONTROL APPARATUS AND METHOD THEREOF

BACKGROUND OF THE INVENTION

1. Field of the Invention

The present invention relates to an air conditioner, and more particularly to an air conditioner operation control apparatus and method thereof for detecting a shape of an inner space where an inner unit of air conditioner is disposed and a position where the inner unit is disposed to thereby enable the air conditioner to perform an appropriate cooling and heating operation according to the shape of the inner space and the position where the inner unit is installed.

2. Description of the Prior Art

Generally, an air conditioner is composed of a compressor, indoor heat exchanger and outdoor heat exchanger, through which refrigerant is circulated to thereby absorb heat (or warm air) and to discharge heat (or cold air) for performance of heating or cooling of a room.

The air conditioner thus described is generally so constructed as to have a predetermined capacity of heating and cooling, and once the air conditioner is installed at a predetermined position in a room for operation, the same detects temperatures in the room and operates heating or cooling according to the detected temperatures of the room.

FIG. 9 is a flow chart for illustrating an operational method of the conventional air conditioner for performing the heating or cooling according to the indoor temperatures.

According to step (S2) in FIG. 9, a user operates a remote controller (or key input unit) to establish a desired indoor temperature and thereby operate air conditioner.

At step (S4), a current indoor temperature is detected by a temperature detecting sensor.

At step (S6), a comparison is made between the indoor temperature and the temperature established by the user.

At step (S6) operation is distinguished between the heating and the cooling. In other words, the air conditioner is operated to perform cooling when the indoor temperature is higher than the established temperature as in step (S8), and the air conditioner is rendered inactivated to thereby stop cooling as in step (S10) when the indoor temperature is lower than the established temperature.

The air conditioner is activated to perform heating as in step (S8) when the indoor temperature is lower than the established temperature, and the air conditioner is rendered inactivated to stop heating as in step (S10) when the indoor temperature is higher than the established temperature.

At this time, cool air or hot air generated from the inner unit of the air conditioner is discharged to indoors by a fan, and the cool air or hot air flow is controlled in its discharged direction (hereinafter referred to as "wind direction") by a vertical louver (up/down deflection louver) and a horizontal louver (left/right deflection louver).

For example, in Japanese Laid Open Patent Application No. Sho 62 (1987)-237242 entitled, "Wind Direction Deflecting Method of Air Conditioner", a technique is disclosed to improve the conditions of a room by controlling an up/down defection louver and a left/right deflection louver according to indoor temperatures detected by a temperature detecting means.

In other words, the wind direction deflecting method of an air conditioner is disclosed wherein an up/down deflecting vane is driven in a horizontal direction and a left/right deflecting vane is driven to a position for directing air in a direction spaced by a maximum distance from an optimum quantity discharge direction established by an installed position of the air conditioner, when temperature detected by the temperature detecting means is in an established temperature region of "A" stored in an established temperature memory. Then, an up/down deflecting van is driven downward when a temperature detected by the temperature detecting means is in a temperature region of B ($A \leqq B$) stored in the established temperature memory means. Thereafter, a left/right deflecting vane is determined by the placement position of the air conditioner, and at the same time, the left/right deflecting vane is deflected to a position defining the optimum quantity discharge direction preset by the air conditioner during its installment, when temperature detected by the temperature detecting means is in an established temperature region of C ($A \leqq B \leqq C$) stored in the established temperature memory means.

Also, in a Japanese Laid Open Patent Application No. Hei 1 (1989)-147243 entitled "An Air Conditioner" which enables control of wind quantity, wind direction and discharged temperature of air by the user in order to provide pleasant air conditioning at all times without operation of a remote controller, in consideration of the influence of radiant heat and the like from a place where people are located, a wall surface or floor. A technique is disclosed wherein a detecting means is installed for detecting infrared rays of a room where the air conditioning is performed, and a temperature distribution of the room is detected by the detecting means, and thereafter the wind quantity, wind direction and discharged temperature of the air are controlled according to the detected temperature distribution.

However, even though the Japanese laid open patent application No. Sho 62-237242 has considerably contributed to the improvement of the living quarters, there are disadvantages in that the wind direction has to be established manually and the air conditioning cannot be accomplished according to forms or shapes of the living quarters.

Furthermore, even though the Japanese laid open patent application No. Hei 1-147243 has disclosed a technique of equally regulating the indoor temperature to thereby provide a pleasant atmosphere to the room, there are still problems in that the performance of air conditioning according to the shape or form of the room is impossible, and the discharge of air to an unnecessary part cannot be prevented, to thereby reduce the efficiency of the air conditioner.

SUMMARY OF THE INVENTION

Accordingly, the present invention is disclosed to solve the aforesaid problems and it is an object of the present invention to provide an effectively pleasant indoor space by detecting a shape of the room where an indoor unit of the air conditioner is installed and a position of the indoor unit relative to the room configuration to thereby allow the wind direction, wind direction angle and the wind quantity to be controlled according to the detected indoor shape and installed position of the indoor unit.

According to one aspect of the present invention, there is provided an air conditioner operation control apparatus comprising: an indoor shape detecting means for detecting the shape of the room for performing the air conditioning; a control means for establishing wind direction and/or wind direction angle control data according to the indoor space shape detected by the indoor shape detecting means; and a regulating means for regulating the wind direction and/or wind direction angle according to the control data established by the control means.

According to another aspect of the present invention, there is provided an air conditioner operation control method comprising: detecting the indoor shape for performing the air conditioning; establishing the wind direction and/or wind direction angle control data according to the detected indoor shape; and regulating the wind direction and/or wind direction angle according to the established control data.

BRIEF DESCRIPTION OF THE DRAWINGS

For a better understanding of the nature and objects of the invention, reference should be made to the following detailed description taken in conjunction with the accompanying drawings in which:

FIGS. 6, 7 and 8 are explanatory drawings for describing the wind direction angle and wind direction according to the air conditioner control apparatus and method of the present invention, wherein FIGS. 6*a* through 6*f*, FIGS. 7*a*, 7*b* and 7*c*, and FIGS. 8*a* through 8*f* are indoor plan views while FIGS. 7*d* through 7*f* are indoor side elevational views.

DETAILED DESCRIPTION OF THE INVENTION

Figure 1:
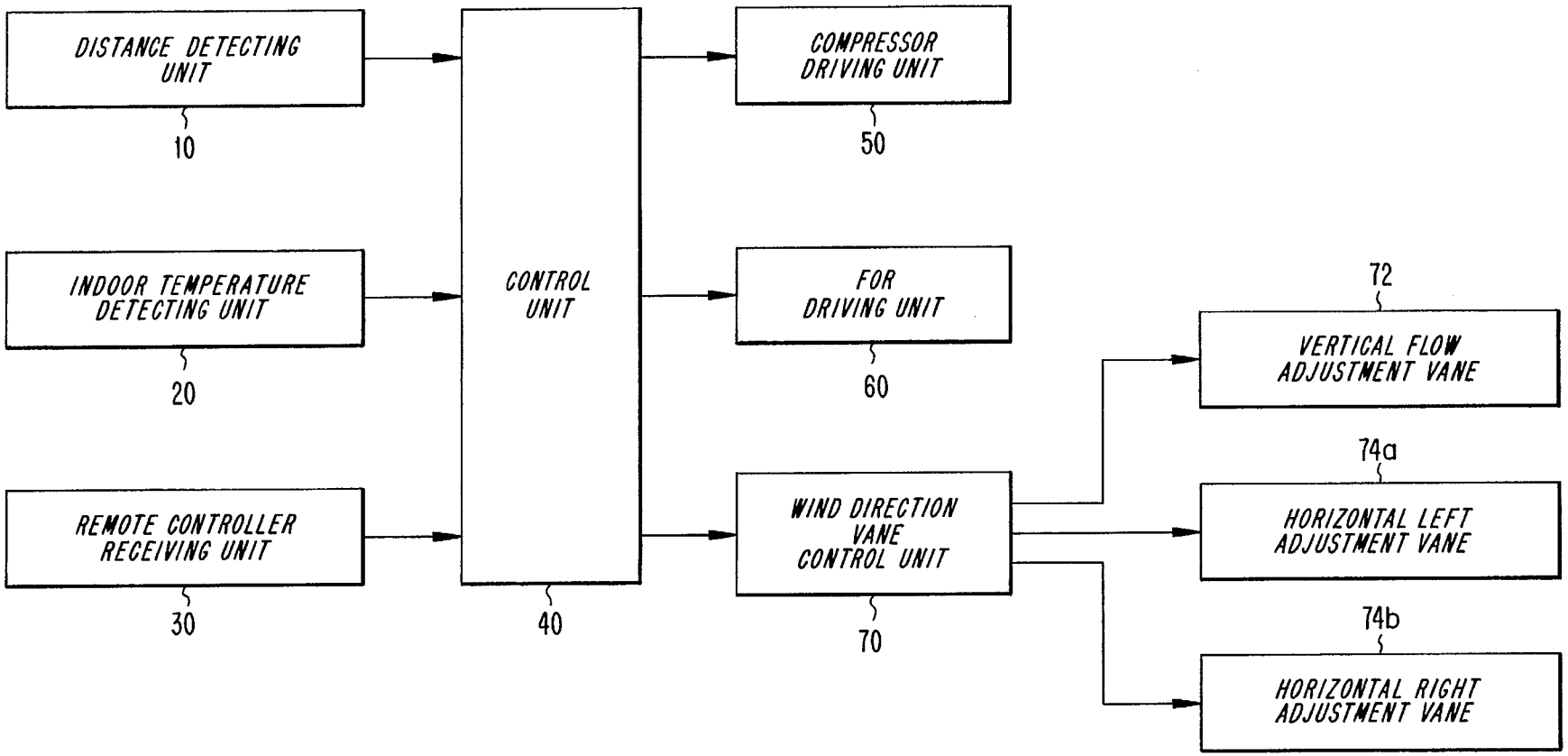
FIG. 1 is a block diagram of a control apparatus for an air conditioner according to the present invention.

FIG. 1 is a block diagram of a control apparatus for an air conditioner according to the present invention.

Reference numeral 10 in FIG. 1 is a distance detecting unit comprising an ultrasonic sensor.

The ultrasonic sensor comprises: a sending unit for generating and sending ultrasonic waves; and a receiving unit for receiving the ultrasonic waves sent out by the sending unit and reflected by an object.

Reference numeral 20 is an indoor temperature sensing unit for detecting the temperature of a place where the indoor unit is installed.

Reference numeral 30 is a remote controller receiving unit for receiving a signal generated from a remote controller when a key on the remote controller is pressed by the user in order to control the air conditioner.

Reference numeral 40 is a control unit for discriminating a distance to the object from the indoor unit as a function of the time when the dispatched ultrasonic waves are received and the speed of the ultrasonic waves. This occurs once a control signal is output to the sending unit of the distance sensing unit 10 to cause the ultrasonic waves to be sent out, so that the ultrasonic waves can then be received by the receiving unit.

The control signal is output in order to control the air conditioner according to the distance of the object to the indoor unit discriminated as described above.

Furthermore, a signal for controlling the air conditioner is output upon receiving various commands of the user received through a temperature data detected by the indoor temperature sensing unit 20 and the remote controller receiving unit 30.

Reference numeral 50 is a compressor driving unit for driving a compressor according to the control signal output form the control unit 40.

The compressor compresses refrigerant.

Reference numeral 60 is a fan driving unit for driving a fan according to the control signal output from the control unit 40.

Generally, the fan comprises an indoor fan installed within an indoor heat exchanger and an outdoor fan installed within an outdoor heat exchanger, but only the indoor fan will be described herein.

Reference numeral 70 is a wind direction vane control unit for controlling horizontal control vanes 74*a* and 74*b* and a vertical control vane 72 according to the control signal output from the control unit 40.

The vertical control vane 72, i.e., the vane which controls the up and down flow of air, extends horizontally at a discharge port of the indoor unit for discharging cool air or warm air into the room to thereby control the wind (i.e., air flow) upwardly and downwardly. The horizontal control vanes 74*a* and 74*b*, i.e., the vanes which control the horizontal direction of wind flow, extend vertically at the discharge port to thereby control the wind direction and the wind direction angle.

The horizontal control vanes 74*a* and 74*b* can be classified into a left horizontal control vane 74*a* and a right horizontal control vane 74*b* which are driven by respective motors.

Meanwhile, the control apparatus of the air conditioner, besides the above cited constructions, is provided with an indication unit for indicating an operational state and the like and a power supply unit and the like for supplying power to an overall system. However, the present application omits a detailed explanation of the same.

Figure 2:
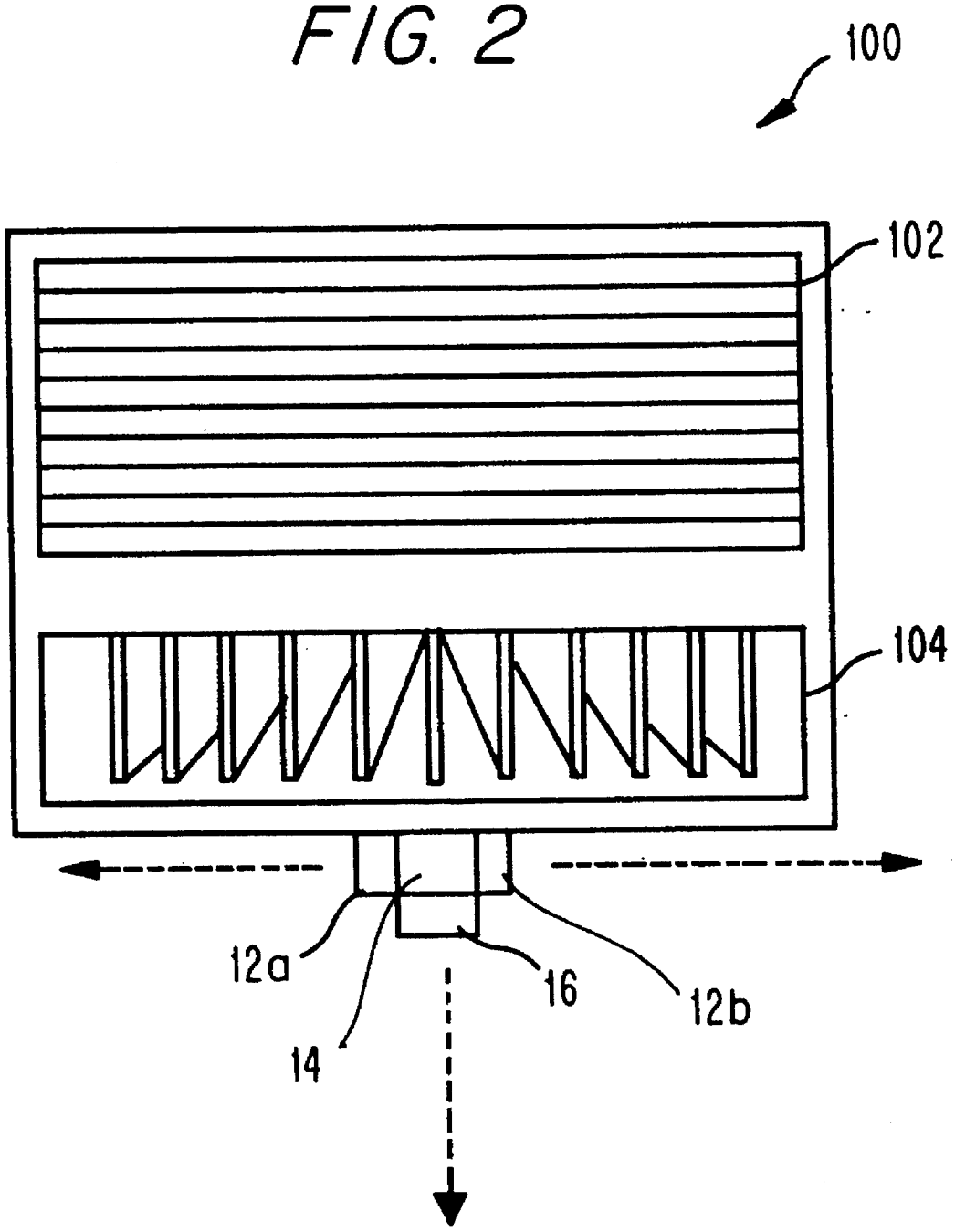
FIG. 2 is a plan view for schematically illustrating an indoor unit of the air conditioner according to the present invention.

FIG. 2 is an elevational view for schematically illustrating an indoor unit 100 of the air conditioner according to the present invention.

A frontal upper area of the indoor unit 100 is formed with a suction port 102 for sucking in indoor air, and under the suction port 102, there is formed a discharge port 104 for discharging to the indoors the air which has been heat-exchanged within the indoor unit 100.

The discharge port 104, as illustrated in FIG. 1, is provided with horizontal control vanes and vertical control vane for adjusting the direction of air discharged into the room.

Furthermore, beneath the indoor unit 100, there are disposed left, right, front and lower side distance detecting sensors 12*a*, 12*b*, 14 and 16.

The left, right, front and lower side distance detecting sensors (12*a*, 12*b*) and (14, 16) are ultrasonic sensors, wherein the left side and right side distance detecting sensors 12*a* and 12*b* are sensors designed to measure a distance between the indoor unit 100 and left and right side walls, respectively. The front side distance detecting sensor 14 is a sensor for measuring a distance between the indoor unit 100 and a front wall. The lower side distance detecting sensor 16 is designed for measuring a distance between the indoor unit 100 and a floor. As a result, a shape of the room can be determined.

Meanwhile, an indoor heat exchanger and an indoor fan (not shown) are disposed within the indoor unit 100.

Figs, 3, 4*a*, 4*b* and 5 are flow charts for illustrating control methods of the air conditioner according to the present invention.

Figure 3:
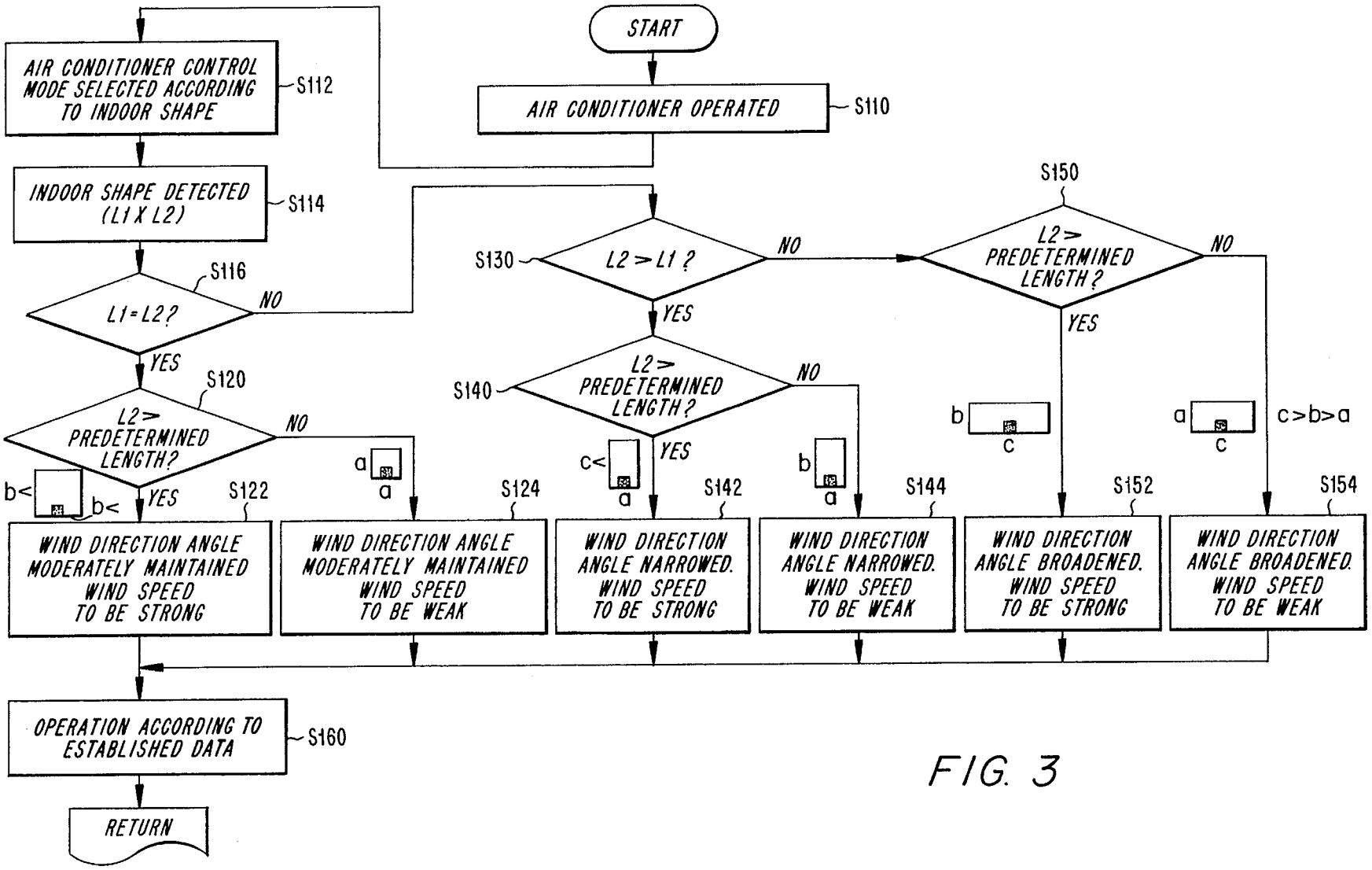
FIGS. 3, 4*a*, 4*b* and 5 are flow charts for explaining a control method of the air conditioner according to the present invention.

FIG. 3 is a first embodiment of the present invention, comprising: an indoor shape detecting step for detecting an indoor shape in order to perform the air conditioning; a data establishment step for establishing the wind direction, wind direction angle adjustment data and wind speed (or wind amount) adjustment data according to the shape of the indoor space detected from the indoor shape detecting step; and a step for adjusting the wind direction, wind direction angle and wind speed according to the adjustment data established by the data establishment step.

Figure 4A:
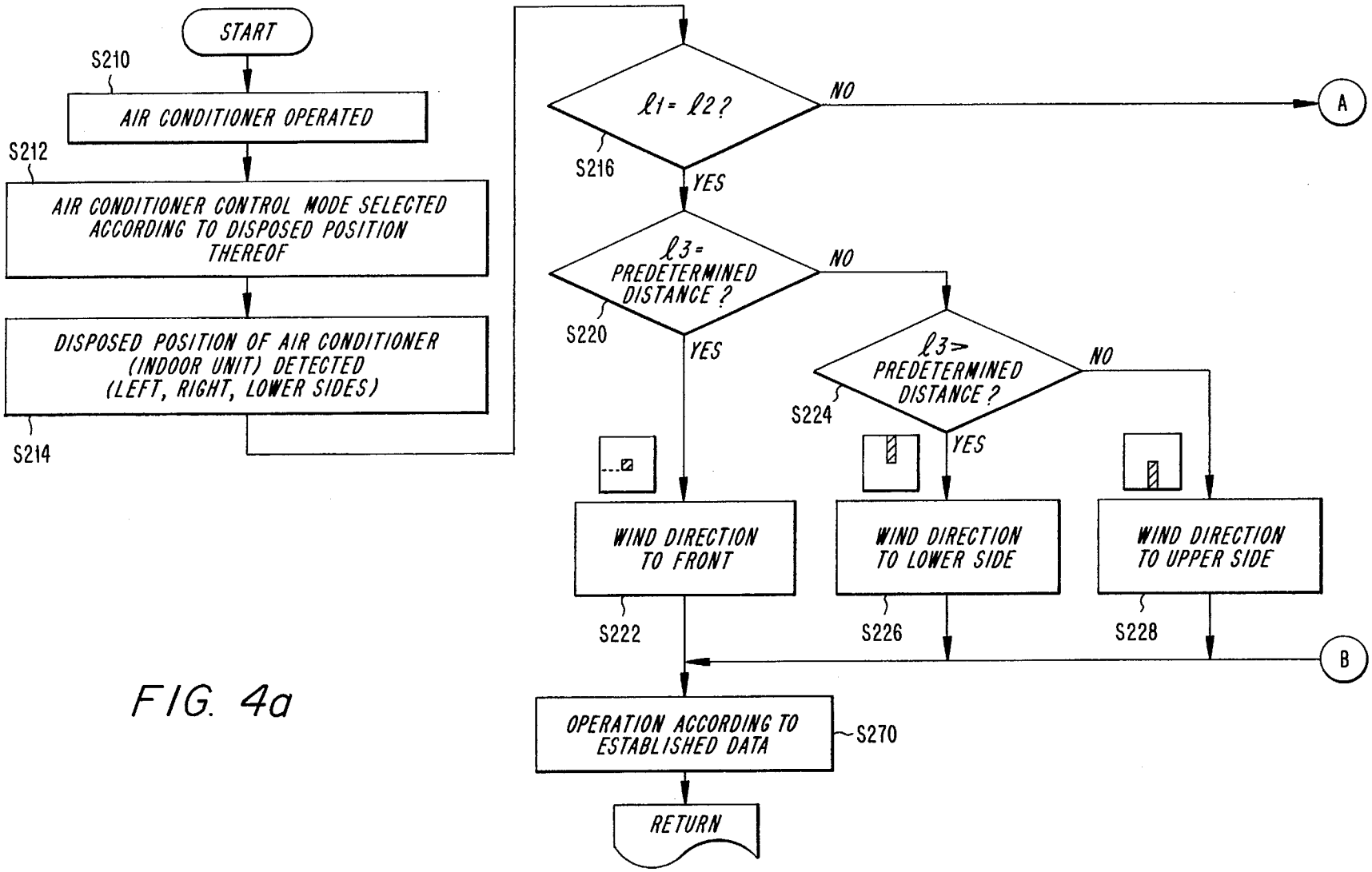
Figure 4B:
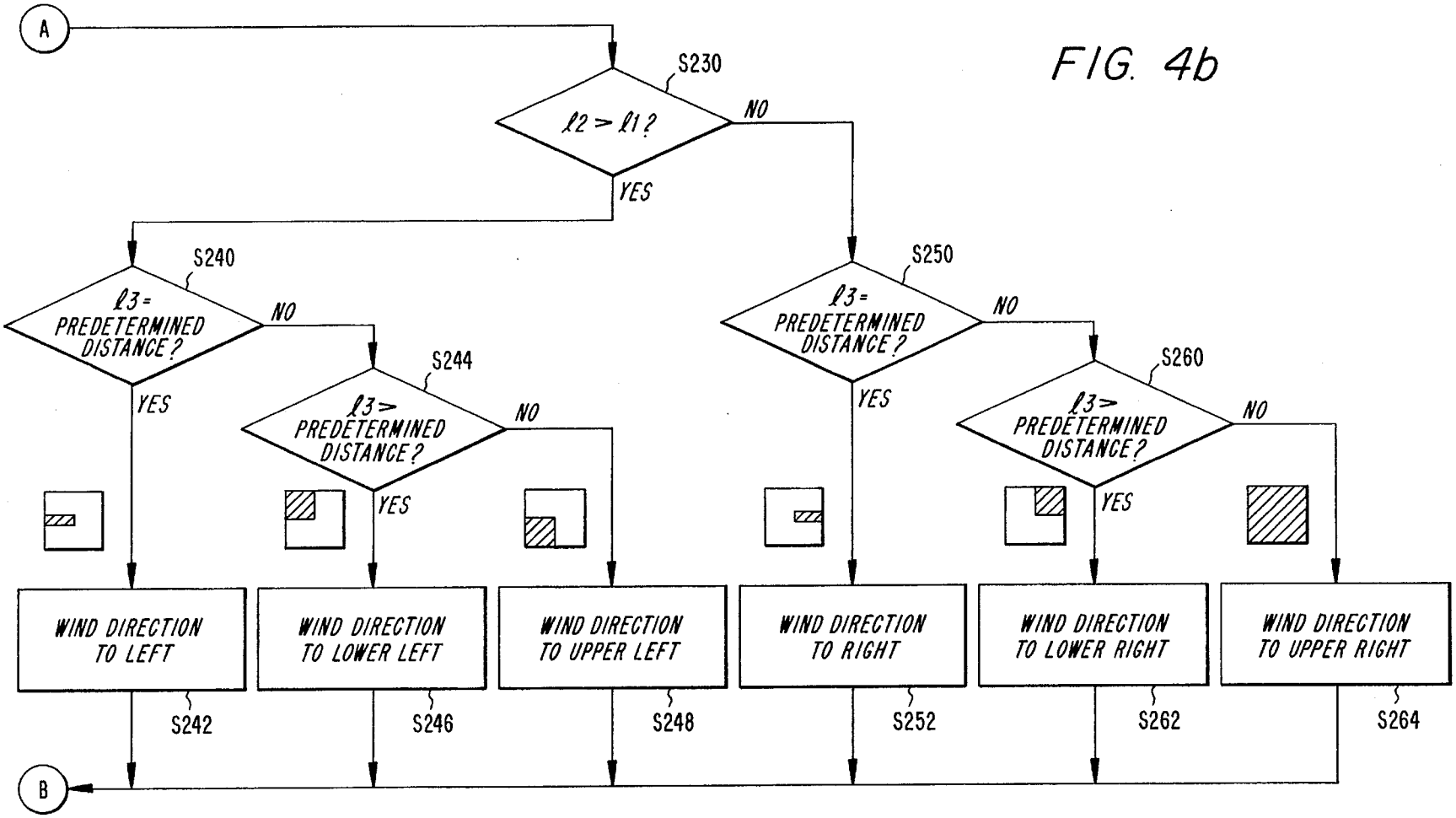

FIG. 4 is a second embodiment of the present invention, comprising: a position detecting step for detecting a position of the indoor unit in order to perform the air conditioning; an adjusted data establishment step for establishing the wind direction, and wind direction angle adjustment data according to the position of the indoor unit detected from the position detecting step; and a wind direction and wind direction angle adjustment step for adjusting the wind direction and wind direction angle according to the adjusted data establishment step.

Figure 5:
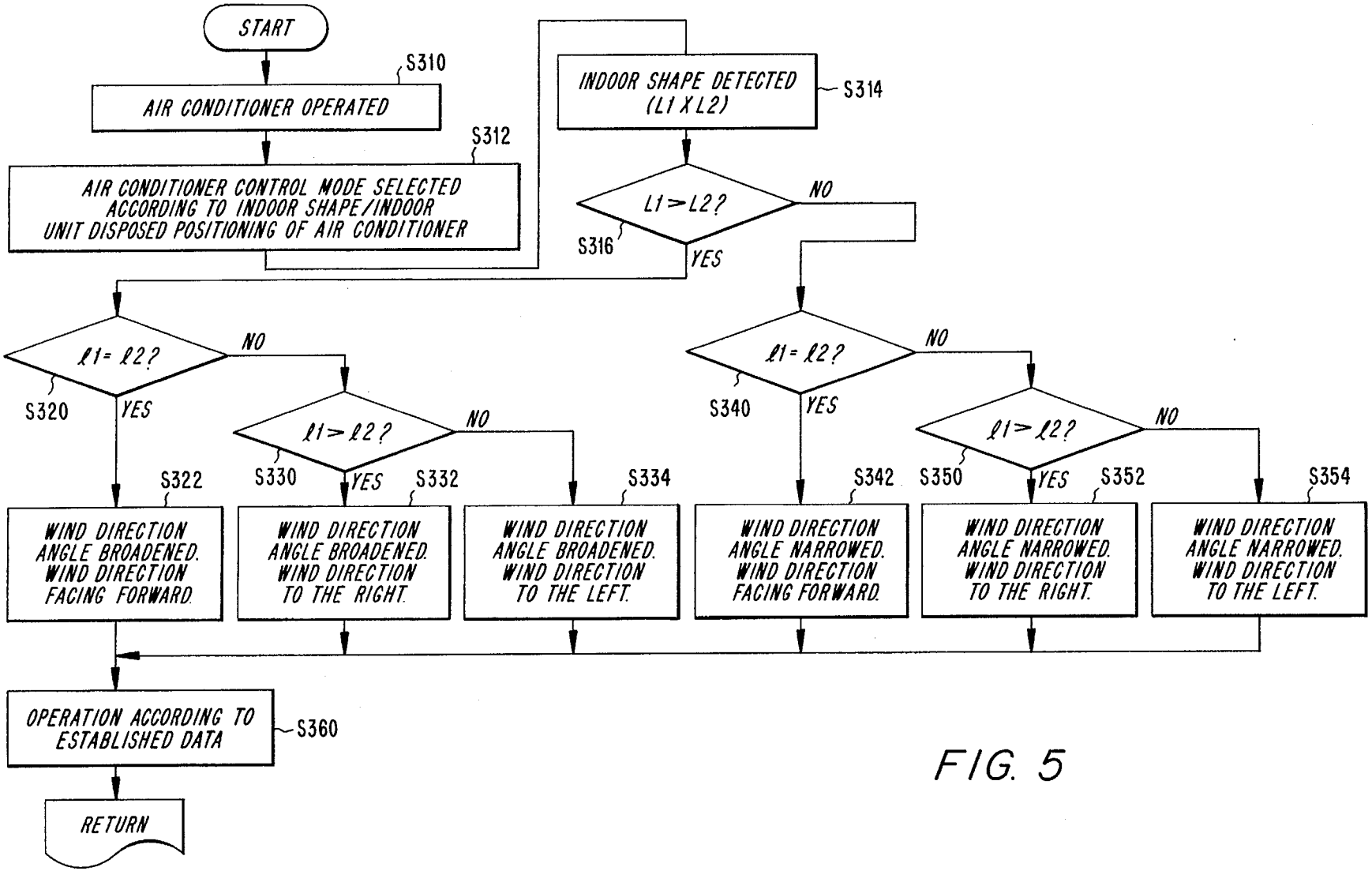
Figure 9:
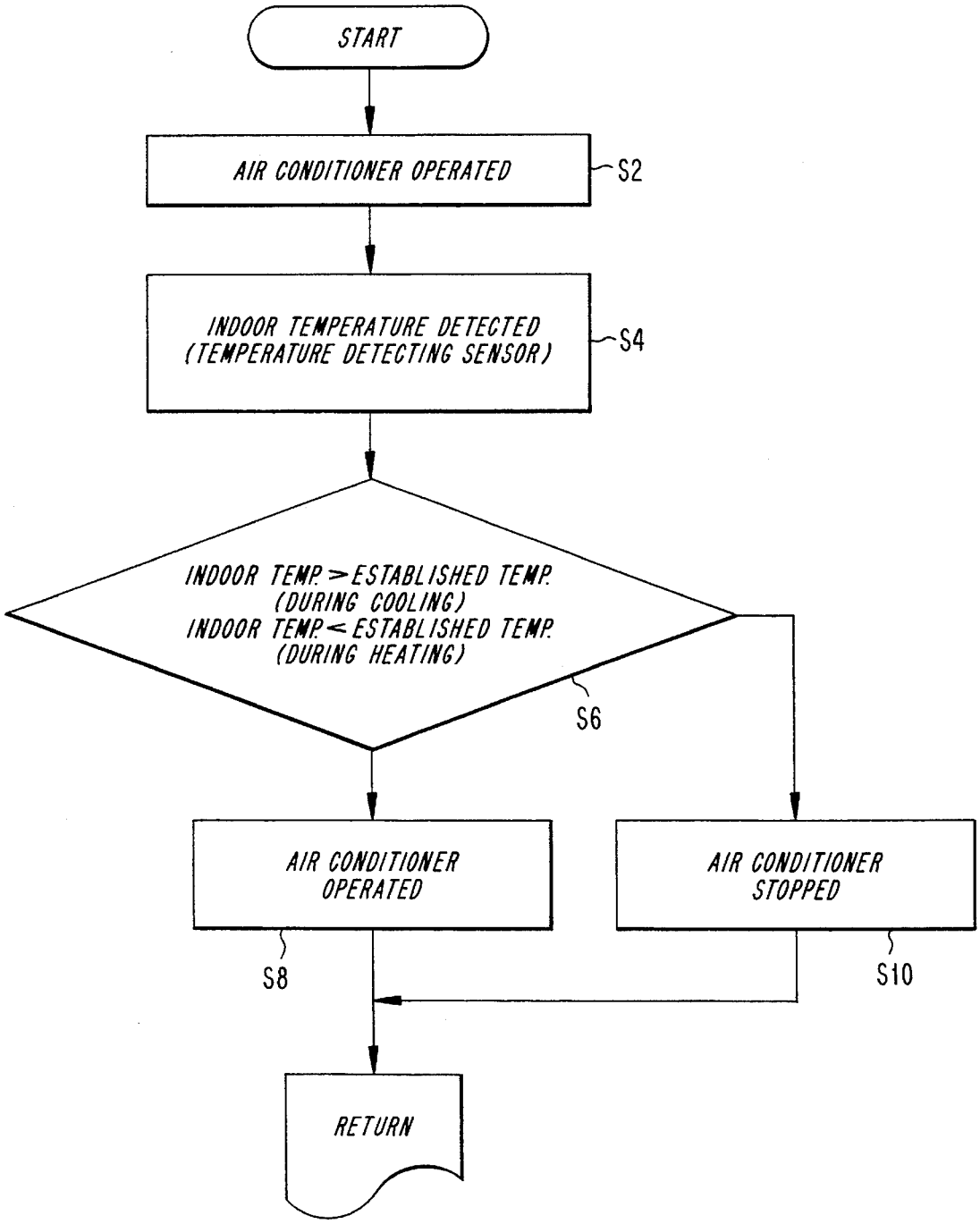
FIG. 9 (PRIOR ART)
FIG. 9 is a flow chart for explaining control method of the conventional air conditioner.

FIG. 5 is a third embodiment of the present invention, comprising: a detecting step for detecting the indoor shape and position of the indoor unit in order to perform the air conditioning; an adjusted data establishment step for establishing the wind direction and wind direction angle adjustment data according to the shape of the indoor space and the position of the indoor unit detected during the detecting step; a wind direction and wind direction angle adjustment step for adjusting the wind direction and wind direction angle according to the adjusted data established during the adjusted data establishment step; and a wind speed adjustment step for adjusting the wind speed according to the adjusted data established during the adjusted data establishment step.

Hereinafter, the control apparatus and method of the air conditioner according to the present invention will be described in detail with reference to the accompanied drawings.

First Embodiment

In FIG. 3, step (S110) is a step for operating the air conditioner, wherein, when the user selects the desired indoor temperature and cooling or heating function by utilizing the remote controller (or key input unit), the remote controller transmits a signal, and the remote controller receiving unit 30 receives the signal.

The signal received at the remote controller receiving unit 30 is input to the control unit 40, which outputs a control signal to the compressor driving unit 50, fan driving unit 60, wind direction vane control unit 70 and the like according to the signal to thereby drive the air conditioner.

At this time, it should be apparent that the control unit 40 is operated according to the indoor temperature detected by the indoor temperature sensing unit 20.

Then, when the user selects at step (S112) an operating mode which requires that the air conditioner operate according to the indoor room shape (form), the control unit 40 drives the distance detecting unit 10 at step (S114) to thereby detect the room shape.

In other words, the control unit 40 during step (S114) drives the right side distance detecting sensor 12*a* in the distance detecting unit 10 to thereby measure a distance (l1) between the indoor unit and the right side wall, and the left side distance detecting sensor 12*b* is driven to measure a distance (l2) between the indoor unit and the left side wall, so that an indoor crosswise length (L1=l1+l2) which is to be covered by the air conditioning is determined.

Furthermore, the front side distance detecting sensor 14 is activated to measure a distance between the indoor unit and a front wall, so that a lengthwise distance L2 of the room is determined.

Step (S116) discriminates whether the measured crosswise length (L1) and lengthwise distance (L2) are equal.

As a result of the discrimination at step (S116), if the two lengths L1 and L2 are the same, the operational flow proceeds to step (S120).

A discrimination is made at step (S120) as to whether the lengthwise distance L2 is longer than a predetermined length.

As a result of the discrimination at step (S120), if the lengthwise distance L2 is longer than the predetermined length, flow proceeds to step (S122).

In other words, if it is determined at steps (S116) and (S120) that the indoor structure is a spacious (large) perfect square (FIG. 6*a*), step (S122) maintains the wind direction level at an average level and establishes a data for strengthening the wind speed, and outputs the control signal thereabout to the wind direction vane control unit 70 and the fan driving unit 60.

The air conditioner is operated at step (S160) according to the established data.

The wind direction vane control unit 70 drives a vertical flow adjustment vane 72 according to the established data to thereby cause the wind direction angle to maintain an average level, and the fan driving unit 60 is so controlled as to output strong wind speed for operation of the air conditioner.

Accordingly, as illustrated in the plan view according to FIG. 6a, the cool air or warm air maintains the wind direction angle and wind speed appropriate for a spacious square indoor structure and is discharged through the discharge port 104 of the indoor unit 100.

As a result of discrimination at step (S120), if the lengthwise length (L2) is shorter than the predetermined length, operational flow proceeds to step (S124) .

In other words, if steps (S116) and (S120) show that the indoor structure is a perfect square but not spacious (large) (FIG. 6*b*), a data is established at step (S124) for maintaining the wind direction angle at an average level and the wind speed at a weak level, and then a corresponding control signal is output to the wind direction vane control unit 70 and the fan driving unit 60.

The wind direction vane control unit 70 drives the vertical flow adjustment vane 72 according to the established data to thereby maintain the wind direction angle at an average level, and the fan driving unit 60 is so controlled as to output the wind speed at a weak level for operation of the air conditioner.

Accordingly, as illustrated in FIG. 6*b*, the cool air or warm air maintains a wind direction angle and wind speed appropriate for a perfect square and small indoor structure to thereafter be discharged to the discharge port 104 of the indoor unit 100.

Meanwhile, as a result of discrimination at step (S116), if the crosswise length (L1) and the lengthwise length (L2) are different, flow advances to step (S130).

A discrimination is made at step (S130) as to whether the lengthwise distance (L2) is longer than the crosswise length (L1).

As a result of discrimination at step (S130), if the lengthwise distance (L2) is longer than the predetermined length, flow advances to step (S142).

In other words, because the indoor structure is revealed to have a spacious non-square rectangular shape (FIG. 6*c*) having a longer lengthwise distance as a result of steps (S116), (S130) and (S140), a data is established at step (S142) for causing the wind direction angle to have an acute angle and the wind speed to be strong, and then a corresponding control signal is output to the wind direction vane control unit 70 and the fan driving unit 60.

At step (S160), the air conditioner is operated according to the data established at the aforesaid step.

In other words, the wind direction vane control unit 70 drives the vertical adjustment vane 72 according to the data established at the aforesaid step to thereby maintain the acute wind direction angle, and the fan driving unit 60 is so controlled to output the wind at high speed.

Accordingly, as illustrated in FIG. 6*c*, the cool air or warm air maintains the wind direction angle and the wind speed appropriate for a lengthy and spacious indoor structure to thereby be discharged through the discharge port 104 of the indoor unit 100.

As a result of discrimination at step (S140), if the lengthwise distance (L2) is shorter than the predetermined length, flow advances to step (S144).

In other words, because the indoor structure is revealed to have a small, non-square rectangular shape (FIG. 6*a*) as a result of steps (S116), (S130) and (S140), a data for an acute wind direction angle and weak wind speed is established at step (S144), and then a corresponding control signal is output to the wind direction vane control unit 70 and fan driving unit 60.

The air conditioner is operated at step (S160) according to the afore-established data.

In other words, the wind direction vane control unit 70 drives the vertical adjustment vane 72 according to the afore-established data to thereby produce a narrow wind direction angle and the fan driving unit 60 is so controlled as to output weak wind speed for operation of the air conditioner.

Accordingly, as illustrated in FIG. 6*d*, the cool or warm air maintains the wind direction angle and the wind speed appropriate for a lengthy and narrow indoor structure to thereafter be discharged through the discharge port 104 of the indoor unit 100.

As a result of step (S130), if the lengthwise distance (L2) is not longer than the crosswise length (L1), a discrimination is made at step (S150) as to whether the lengthwise distance (L2) is longer than the predetermined length.

As a result of step (S150), if the lengthwise distance (L2) is longer than the predetermined length, flow proceeds to step (S152).

In other words, because the indoor structure has a shape of a lengthy and spacious non-square crosswise rectangle (FIG. 6*e*) as revealed by steps (S116), (S130) and (S150), a data is established for broadening the wind direction angle and for strengthening the wind speed at step (S152), and then a corresponding control signal is output to the wind direction vane control unit 70 and the fan driving unit 60.

The air conditioner is operated at step (S160) according to the afore-established data.

In other words, the wind direction vane control unit 70 drives the vertical adjustment vane 72 according to the afore-established data to produce a broad wind direction angle, and the fan driving unit 60 is so controlled as to output strong wind speed for operation of the air conditioner.

Accordingly, as illustrated in FIG. 6*e*, the cool air or warm air maintains the wind direction angle and wind speed appropriate for an indoor space of lengthy and spacious area crosswise to thereby be discharged through the discharge port 104 of indoor unit 100.

As a result of discrimination at step (S150), if the lengthwise distance (L2) is shorter than the predetermined length, flow proceeds to step (S154).

In other words, because the indoor structure has a shape of a non-square, lengthy crosswise rectangle of not much space (FIG. 6*f*) as a result of steps (S116), (S130) and (S150), a data is established for a broad wind direction angle and a weak wind speed at step (S154), and then a corresponding control signal is output to the wind direction vane control unit 70 and the fan driving unit 60.

The air conditioner is operated at step (S160) according to the afore-established data.

In other words, the wind direction vane control unit 70 drives the vertical adjustment vane 72 according to the afore-established data to thereby produce a broad wind direction angle, and the fan driving unit 60 is so controlled to have a weak wind speed for operation of the air conditioner.

Accordingly, as illustrated in FIG. 6*f*, the cool air or warm air maintains the wind direction angle and wind speed appropriate for a crosswise lengthy but narrow indoor structure to there after be output through the discharge port 104 of the indoor unit 100.

As noted from the foregoing, according to the air conditioner operation control apparatus and method thereof, the wind direction angle and wind speed are maintained according to the indoor structure to thereby enable to provide a comfortable indoor space.

Second Embodiment

In FIG. 4, step (S210) is a step for activating the air conditioner, which is the same as the step (S110) already explained in the first embodiment.

When the user selects an operating mode which operates according to a position where the indoor unit 100 of the air conditioner is disposed, the control unit 40 drives the distance detecting unit 10 at step (S214) to thereby detect a position of the indoor unit 100.

In other words, the control unit 40 activates the right side distance detecting sensor 12*a* of the distance detecting unit 10 at step (S214) to measure a distance l1 (hereinafter to be referred to as "a first distance") between the indoor unit an the right side wall, and activates the left side distance detecting sensor 12*b* to measure a distance l2 (hereinafter to be referred to as "a second distance") between the indoor unit and the left side wall.

Furthermore, the lower side distance detecting sensor 16 is activated to thereby measure a disposed height l3 (hereinafter to be referred to as "a third distance") between the indoor unit and the floor.

A discrimination is made at step (S216) as to whether the afore-mentioned first distance (l1) and the second distance (l2) are the same length.

As a result of the discrimination at step (S216), if the two distances are the same (FIG. 7*a*), flow advances to step (S220).

A discrimination is made at step (S220) as to whether the third distance (l3) is the same length as the predetermined length. If the two lengths are the same (FIG. 7*d*), flow proceeds to perform step (S222).

In other words, because the indoor unit 100 is disposed horizontally centrally and vertically centrally on the wall surface (FIGS. 7*a*, 7*d*) as discriminated by the afore-mentioned step, a data for maintaining a horizontally forward wind direction is established at step (S222), so that a corresponding control signal can be output to the wind direction vane control unit 70.

The air conditioner is operated at step (S270) according to the afore-established data.

In other words, the wind direction vane control unit 70 activates the vertical adjustment vane 72 and the horizontal flow adjustment vanes 74*a* and 74*b* according to the afore-established data to thereby cause the wind direction to be directed horizontally forwardly.

Accordingly, the cool air or warm air discharged from the discharge port 104 of the indoor unit 100, as illustrated in FIGS. 7*a* and 7*d*, is directed horizontally forwardly toward a center of the room.

As a result of discrimination at step (S220), if the third distance (l3) is not the same as the predetermined length, flow advances to step (S224).

A discrimination is performed at step (S224) as to whether the third distance (l3) is longer than the predetermined length.

As a result of discrimination at step (S224), if the third distance (l3) is longer than the predetermined length (FIG. 7*e*), flow advances to step (S226).

In other words, because the indoor unit 100 is disposed horizontally centrally but vertically nearer to the ceiling than to the floor (FIGS. 7*a*, 7*e*) as a result of step (S226), data is established at step (S226) for maintaining a forwardly downward wind direction, and a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to be downwardly and forwardly.

Accordingly, the cool air or warm air discharged from the discharge port 104 of the indoor unit 100, as illustrated in FIGS. 7*a* and 7*e*, is directed toward the center of the room.

As a result of the discrimination at step (S224), if the third distance (l3) is not longer than the predetermined length (FIG. 7*f*), flow proceeds to step (S228) .

In other words, because the indoor unit 100 is disposed horizontally centrally but vertically nearer to the floor than to the ceiling (FIGS. 7*a*, 7*f*), a data is established at step (S228) for maintaining the wind direction forwardly upwardly, and a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to travel forwardly and upwardly.

Accordingly, the cool or warm air discharged from the discharge port 104 of the indoor unit 100, as illustrated in FIGS. 7*a* and 7*f*, is directed toward the center area of the room.

As a result of step (S216), if the first distance (l1) and the second distance (l2) are not the same, flow advances to step (S230).

A discrimination is performed at step (S230) as to whether the second distance (l2) is longer than the first distance (l1).

As a result of discrimination at step (S230), if the second distance (l2) is longer than the first distance (l1) (FIG. 7*b*), flow proceeds to step (S240).

A discrimination is performed at step (S240) as to whether the third distance (l3) is the same as the predetermined distance.

As a result of discrimination at step (S240), if the third distance (l3) is the same as the predetermined distance (FIG. 7*d*), flow proceeds to step (S242).

In other words, because the indoor unit 100 is disposed vertically centrally, but horizontally to the right on the wall surface (FIG. 7*b*, 7*d*), a data is established at step (S242) for maintaining the wind horizontally leftwards, and then a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to flow horizontally toward the left side of the room.

Accordingly, the cool or warm air discharged from the discharge port 104 of the indoor unit 100, as illustrated in FIGS. 7*b* and 7*d*, is directed toward the center of the room.

As a result of the discrimination at step (S240), if the third distance (l3) is not the same as the predetermined length, flow proceeds to step (S244).

A discrimination is performed at step (S244) as to whether the third distance (l3) is longer than the predetermined length.

As a result of discrimination at step (S244), if the third distance (l3) is longer than the predetermined length (FIG. 7*e*), flow advances to step (S246).

In other words, because the indoor unit 100 is disposed at an upper right section of the wall surface (FIGS. 7*b*, 7*e*), a data is established at step (S246) for maintaining the wind direction downwardly and leftwardly, and then a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to travel downwardly and leftwardly.

Accordingly, the cool or warm air discharged from the discharge port 104 of the indoor unit 100, as illustrated in FIGS. 7*b* and 7*e*, is directed toward the center of the room.

As a result of discrimination at step (S244), if the third distance (l3) is not longer than the predetermined length (FIG. 7*f*), flow advances to step (S248).

In other words, because the indoor unit 100 is disposed at the lower right section of the wall surface (FIGS. 7*b*, 7*f*), a data is established at step (S248) for maintaining the wind direction upwardly and leftwardly, and then a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to travel upwardly and leftwardly.

Accordingly, the cool air or warm air discharged from the discharge port 104 of the indoor unit 100, as illustrated in FIGS. 7*b* and 7*f*, is directed toward the center of the room.

As a result of discrimination at step (S230), if the second distance (l2) is not the same as (i.e., is shorter than) the first distance (l1) (FIG. 7*c*), flow proceeds to perform step (S250).

A discrimination is performed at step (S250) as to whether the third distance (l3) is the same as the predetermined length.

As a result of discrimination at step (S250), if the third distance (l3) is the same as the predetermined length (FIG. 7*d*), flow advances to perform step (S252).

In other words, because the indoor unit 100 is disposed at the left center section of the wall surface (FIGS. 7*c* and 7*d*), data is established at step (S252) for maintaining the wind direction horizontally toward the right, and then a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to cause the wind direction to flow horizontally to the right.

Accordingly, the cool or warm air discharged from the discharge port 104 of the indoor unit 100, as illustrated in FIGS. 7*c* and 7*d*, is directed toward the center of the room.

As a result of discrimination at step (S250), if the third distance (l3) is not the same as the predetermined length, flow advances to step (S260).

A discrimination is performed at step (S260) as to whether the third distance is longer than the predetermined length.

As a result of discrimination at step (S260), if the third distance (l3) is longer than the predetermined length (FIG. 7*e*), flow proceeds to step (S262).

In other words, because the indoor unit 100 is disposed at an upper left position of the wall surface (FIGS. 7*c*, 7*e*), data is established at step (S262) for maintaining the wind direction toward the lower right side, and then, a corresponding control signal is output to the wind direction vane control unit 70.

The air conditioner is operated at step (S270) according to the afore-established data.

In other words, the wind direction vane control unit 70 activates the vertical adjustment vane 72 and the horizontal adjustment vanes 74*a* and 74*b* according to the afore-established data to thereby cause the wind direction to travel toward the lower right side.

Accordingly, the cool or warm air discharged from the discharged port 104 of the indoor unit 100, as illustrated in FIGS. 7*c* and 7*e*, is directed toward the center of the room.

As a result of discrimination at step (S260), if the third distance (l3) is not longer than the predetermined length (FIG. 7*f*), flow proceeds to step (S264).

In other words, because the indoor unit 100 is disposed at the lower left side of the wall surface (FIGS. 7*c*, 7*f*), data is established at step (S264) for maintaining the wind direction toward the upper right side, and then a corresponding control signal is output to the wind direction vane adjustment unit 70.

The air conditioner is operated at step (S270) according to the afore-established data.

In other words, the wind direction vane adjustment unit 70 activates the vertical adjustment vane 72 and the horizontal adjustment vanes 74*a* and 74*b* according to the afore-established data, thereby causing the wind direction to travel toward the upper right side.

Accordingly, the cool or warm air discharged from the discharge port 104 of the indoor unit 100, as illustrated in FIGS. 7*c* and 7*f*, is directed toward the center of the room.

As seen from the foregoing, according to the air condition operation control apparatus and method thereof, the appropriate wind direction according to the position of the indoor unit 100 can be maintained to provide a comfortable and effective indoor space.

Third Embodiment

In FIG. 5, step (S310) is a step for activating the air conditioner, which is the same as step (S110) already described in the first embodiment.

When the user selects an operating mode which operates according to both the room shape and a position where the indoor unit 100 of the air conditioner is disposed, the control unit 40 activates the distance detecting unit 10 at step (S314) to thereby detect the indoor room shape and the position of the indoor unit 100.

In other words, the control unit 40 activates the right side distance detecting sensor 12*a* of the distance detecting unit at step (S314) to measure a distance l1 (hereinafter to be referred to as "a first length") between the indoor unit and a right side wall, and then drives the left side distance detecting sensor 12*b* to measure a distance l2 (hereinafter referred to as "a second length") between the indoor unit and the left side wall for calculation of a crosswise length (L1=l1+l2) of the room where the air conditioning is to be performed.

Furthermore, a front side distance detecting sensor 14 is activated to measure the distance between the indoor unit and a front side wall for calculation of a longitudinal length L2 of the room.

A discrimination is made at step (S316) as to whether the afore-measured crosswise length (L1) is longer than the longitudinal length (L2).

As a result of discrimination at step (S316), if the crosswise length (L1) is longer than the longitudinal length (L2), flow proceeds to step (S320).

A discrimination is performed at the step (S320) as to whether the first length (l1) measured at the step (S314) is the same as the second length (l2).

As a result of discrimination at step (S320), if the first length (l1) is the same as the second length (l2), flow advances to step (S322).

In other words, because the room where the air conditioning is to be performed has a shape of a long crosswise rectangle, and the indoor unit of the air conditioner is disposed at the center of the room (FIG. 8*a*), according to steps (S316) and (S320), a data is established at step (S322) for broadening the wind direction angle and directing the wind horizontally centrally toward the center of the room, and then a corresponding control signal is output to the wind direction vane control unit 70.

The air conditioner is operated at step (S360) according to the afore-established data.

In other words, the wind direction vane control unit 70 activates the horizontal adjustment vanes 74*a* and 74*b* according to the afore-established data to thereby cause the wind direction angle to broaden and the wind direction to be horizontally toward the center for operation of the air conditioner.

Accordingly, as illustrated in FIG. 8*a*, the cool or warm air maintains the wind direction angle and the wind direction appropriate for the shape of the room, to thereafter be discharged through the discharge port 104 of the indoor unit 100.

As a result of discrimination at step (S320), if the first length (l1) is not the same as the second length (l2), flow proceeds to step (S330).

As a result of discrimination at step (S330), if the first length (l1) is longer than the second length (l2), flow proceeds to step (S332).

In other words, because the room where the air conditioning is to be performed has a shape of a transversely long rectangle, and the indoor unit 100 of the air conditioner is disposed at a left side of the room (FIG. 8*b*) according to steps (S316), (S320) and (S330), data is established at step (S332) for broadening the wind direction angle and directing the wind toward the right side, and then a corresponding control signal is output to the wind direction vane control unit 70.

The air conditioner is operated at step (S360) according to the afore-established data.

In other words, the wind direction vane control unit 70 drives the horizontal flow adjustment vanes 74*a* and 74*b* according the afore-established data to thereby broaden the wind direction angle and to direct the wind toward the right side for operation of the air conditioner.

Accordingly, as illustrated in FIG. 8*b*, the cool air or warm maintains the wind direction angle and wind direction appropriate for the indoor structure to thereby be discharged to the discharge port 104 of the indoor unit 100.

As a result of discrimination at step (S330), if the first length (l1) is shorter than the second length (l2), flow proceeds to step (S334).

In other words, because the room where the air conditioning is to be performed has a shape of a transversely long rectangle, and the indoor unit 100 of the air conditioner is disposed at the right side of the room according to steps (S316), (S320) and (S330), data is established at the step (S334) for broadening the wind direction angle and directing the wind toward the left side, and then a corresponding control signal is output to the wind direction vane control unit 70.

The air conditioner is operated at step (S360) according to the afore-established data.

In other words, the wind direction vane control unit 70 drives the horizontal flow adjustment vanes 74*a* and 74*b* according to the afore-established data to thereby broaden the wind direction angle and to direct the wind toward the left side for operation of the air conditioner.

Accordingly, as illustrated in FIG. 8*c*, the cool air or warm air maintains a wind direction angle and wind direction appropriate for the structure of the room to thereafter be discharged to the discharge port 104 of the indoor unit 100.

Meanwhile, as a result of discrimination at the step (S316), if the transverse length (l1) is shorter than the longitudinal length (l2), flow proceeds to step (S340).

A discrimination is made at step (S340) as to whether the first length (l1) and the second length (l2) measured at the step (S314) are equal.

As a result of discrimination at the step (S340), if the first length (l1) and the second length (l2) are the same, flow proceeds to step (S342).

In other words, because the room where the air conditioning is to be performed has the shape of a longitudinally long rectangle and the indoor unit 100 of the air conditioner is disposed at the center of the room according to the discrimination results at the steps (S316) and (S340), data is established at step (S342) for broadening the wind direction angle and directing the wind toward the center, and then, a corresponding control signal is output to the wind direction vane control unit 70.

The air conditioner is operated at step (S360) according to the afore-established data.

In other words, the wind direction vane control unit 70 drives the horizontal adjustment vanes 74*a* and 74*b* according to the afore-established data to cause the wind direction angle to be narrow and the wind direction to be directed toward the center for operation of the air conditioner.

Accordingly, as illustrated in FIG. 8*d*, the cool air or warm air maintains a wind direction angle and wind direction appropriate for the structure of the room to thereafter be discharged to the discharge port 104 of the indoor unit 100.

As a result of discrimination at the step (S340), if the first length (l1) is not the same as the second length (l2), flow proceeds to step (S350).

As a result of discrimination at the step (S350), if the first length (l1) is not the same as the second length (l2), flow proceeds to step (S352).

In other words, because the room where the air conditioning is to be performed has a shape of a longitudinally long rectangle and the indoor unit 100 of the air conditioner is disposed at the left side according to the discrimination results at the steps (S316), (S340) and (S350), data is established at the step (S352) for narrowing the wind direction angle and directing the wind toward the right side, and then, an corresponding control signal is output to the wind direction vane control unit 70.

The air conditioner is operated at step (S360) according to the afore-established data.

In other words, the wind direction vane control unit 70 drives the horizontal adjustment vanes 74*a* and 74*b* according to the afore-established data to thereby narrow the wind direction angle and direct the wind toward the right side for operation of the air conditioner.

Accordingly, as illustrated in FIG. 8*c*, the cool or warm air maintains a wind direction angle and wind direction appropriate for the structure of the room to thereafter be discharged to the discharge port 104 of the indoor unit 100.

As a result of discrimination at the step (S350), if the first length (l1) is shorter than the second length (l2), flow proceeds to step (S354).

In other words, because the room where the air conditioning is to be performed has a shape of a longitudinally long rectangle, and the indoor unit 100 of the air conditioner is disposed at the right side of the room according to the discrimination results at the steps (S316), (S340) and (S350), data is established at the step (S354) for narrowing the wind direction angle and directing the wind toward the left side, and then, a corresponding control signal is output to the wind direction vane control unit 70.

The air conditioner is operated at step (S360) according to the afore-established data.

In other words, the wind direction vane control unit 70 drives the horizontal adjustment vanes 74*a* and 74*b* according to the afore-established data to thereby narrow the wind direction angle and to direct the wind toward the left side for operation of the air conditioner.

Accordingly, as illustrated in FIG. 8*f*, the cool or warm air maintains a wind direction angle and wind direction appropriate for the structure of the room to thereafter be discharged to the discharge port 104 of the indoor unit 100.

As seen from the foregoing description, the air conditioner operation control apparatus and method thereof, the wind direction angle and the wind direction are set in accordance with the shape of the room and position of the indoor unit, to thereby provide a delightful optimum room temperature.

Meanwhile, although the position of the indoor unit has been detected only by the left side and right side distance detecting sensors 12*a* and 12*b* in the third embodiment, it should be apparent that the height thereof can be measured by the lower side distance detecting sensor 16 to control the wind direction.

Furthermore, the control of the wind speed has not been described in the foregoing but it should be apparent that the wind speed can be controlled by the afore-detected shape of the room and the distance to the front detected by the front side distance detecting sensor 14.

As apparent from the above description, the air conditioner operation control apparatus and the method thereof according to the invention detects automatically the position of the indoor unit of the air conditioner, and provides a signal which controls the wind direction angle, wind direction, and wind speed to thereby provide maximized operational efficiency and comfortable indoor space.

Although the preferred embodiments of the invention have been disclosed for illustrative purposes, various modifications and changes are possible without departing from the scope and spirit of the present invention.

Although the above description has explained the structure of the room, wind direction angle, wind direction and wind speed in detailed examples it should also be apparent that the air conditioner can be controlled by more itemized examples.

Furthermore, the present invention has described in detail the distance detecting sensors but the number of the sensors can generally be increased or decreased.

It should be noted that the present invention is not limited by the preferred embodiments and the flow charts can be provided in various ways.

What is claimed is:

1. An air conditioner operation control method, the method comprising;

an indoor shape detecting step for detecting an indoor shape in order to perform the air conditioning;

a data establishment step for establishing the wind direction and/or wind direction angle adjustment data according to the shape of the indoor space detected from the indoor shape detecting step; and a step for adjusting the wind direction and/or wind direction angle according to the adjustment data established by the data establishment step.

2. An air conditioner operation control method as defined in claim 1, wherein the indoor shape detecting step comprises:

a distance detecting step for detecting a transverse length which is a distance from the indoor unit of the air conditioner to the left and right wall surfaces in the indoor space and a longitudinal length which is a distance to a front wall surface; and a shape discrimination step for comparing the transverse length and the longitudinal length detected from the distance detecting step to thereby discriminate the shape of the indoor space.

3. An air conditioner operation control method as defined in claim 1, wherein the step for adjusting the wind direction and/or wind direction angle adjusts the wind direction and/or the wind direction angle according to the afore-detected shape of the indoor space.

4. An air conditioner operation control method as defined in claim 1, wherein the indoor shape detecting step comprises:

a distance detecting step for detecting the transverse length which is a distance from the indoor unit of the air conditioner to left and right wall surfaces of the indoor space and the longitudinal length which is a distance to the front wall surface and a disposed height which is a distance to a floor; and a shape discrimination step for comparing the transverse length, longitudinal length and the disposed height detected at the distance detecting step to thereby discriminate the shape of the indoor space.

5. An air conditioner operation control method as defined in claim 4, wherein the step for adjusting the wind direction and/or wind direction angle adjusts the wind direction up, down, left and right and/or wind direction angle.

6. An air conditioner operation control method as defined in claim 1, further comprising:

a step for establishing a wind speed adjustment data according to the shape of the indoor space thus detected; and a step for adjusting the wind speed according to the adjusted data thus established.

7. An air conditioner operation control method, the method comprising:

a detecting step for detecting the indoor shape in order to perform the air conditioning;

a step for detecting a disposed position of the indoor unit in order to perform the air conditioning;

an adjusted data establishment step for establishing the wind direction and/or wind direction angle adjustment data according to the shape of the indoor space and the disposed position of the indoor unit detected at the detecting step; and a step for adjusting the wind direction and/or wind direction angle according to the adjusted data established at the adjusted data establishment step.

8. An air conditioner operation control method as defined in claim 7, wherein the detecting step for detecting the indoor space comprises;

a distance detecting step for detecting the transverse length which is a distance from the indoor unit of the air conditioner to the left and right wall surfaces of the indoor space, the longitudinal length which is a distance to the front wall surface and the disposed height which is a distance to the floor; and a shape discrimination step for comparing the transverse length, longitudinal length and the disposed height detected at the distance detecting step to thereby discriminate the shape of the indoor space.

9. An air conditioner operation control method as defined in claim 7, wherein the step for adjusting the wind direction and/or wind direction angle adjusts the wind direction up, down, left and right and/or the wind direction angle according to the shape of the indoor space detected in the indoor shape detecting step.

10. An air conditioner operation control method as defined in claim 7, further comprising:

a step for establishing a wind speed adjustment data according to the shape of the indoor space and/or the disposed position of the indoor unit thus detected; and a step for adjusting the wind speed according to the adjusted data thus established.

11. An air conditioner operation control apparatus, the apparatus comprising:

indoor shape detecting means for detecting the shape of the indoor space for performing the air conditioning;

control means for establishing wind direction and/or wind direction angle adjustment data according to the indoor space shape detected by the indoor shape detecting means; and adjusting means for adjusting the wind direction and/or wind direction angle according to the adjusted data established by the control means.

12. An air conditioner operation control apparatus as defined in claim 11, wherein the indoor shape detecting means includes a distance detecting sensor for detecting a distance to the left side, right side and the front wall surface from the indoor unit of the air conditioner.

13. An air conditioner operation control apparatus as defined in claim 11, wherein the adjusting means for adjusting the wind direction and/or wind direction angle comprises an adjusting louver for adjusting the wind direction and/or wind direction angle by receiving a wind direction and/or wind direction angle adjustment data from the control means.

14. An air conditioner operation control apparatus as defined in claim 11, wherein the indoor shape detecting means comprises the distance detecting sensor for detecting a distance to the left side, right side and front wall surface from the indoor unit of the air conditioner and a distance to the floor.

15. An air conditioner operation control apparatus as defined in claim 11, wherein the wind direction/wind direction angle adjusting means comprises:

an adjusting louver for adjusting the wind direction and/or wind direction angle by receiving the wind direction and/or the wind direction angle adjusting data from the control means.

16. An air conditioner operation control apparatus as defined in claim 11, wherein the control means further performs an establishment of wind speed adjusting data according to the shape of the indoor space detected from the indoor shape detecting means.

17. An air conditioner operation control apparatus as defined in claim 16, further including a wind speed adjusting means for adjusting the wind speed according to the adjusted data established by the control means.

18. An air conditioner operation control apparatus, the apparatus comprising:

indoor shape detecting means for detecting the shape of indoor space for performing the air conditioning;

indoor unit position detecting means for detecting the position of the indoor unit for performing the air conditioning;

control means for establishing wind direction adjusting data according to the indoor space shape and/or indoor unit position detected by the indoor shape detecting means and/or indoor unit position detecting means; and wind direction/wind direction angle adjusting means for adjusting the wind direction and/or the wind direction angle according to the adjusted data established by the control means.

19. An air conditioner operation control apparatus as defined in claim 18, wherein the indoor shape detecting means includes a distance detecting sensor for detecting a distance to the left and right sides, front wall surface and the floor from the indoor unit of the air conditioner.

20. An air conditioner operation control apparatus as defined in claim 18, wherein the wind direction/wind direction angle adjusting means includes:

an adjusting louver for adjusting the wind direction and/or wind direction angle by receiving the wind direction and/or wind direction angle adjusting data from the control means; and an adjusting lever for adjusting the wind direction and/or wind direction angle by receiving the wind direction and/or wind direction angle adjusting data from the control means.

21. An air-conditioner operation control apparatus as defined in claim 18, wherein the control means further establishes the wind speed data according to the indoor space shape and the position of the indoor unit detected by the indoor shape detecting means and indoor unit position detecting means.

22. An air conditioner operation control apparatus as defined in claim 18, further comprising a wind speed adjusting means for adjusting the wind speed according to the adjusted data established by the control means.

* * * * *